US005117076A

United States Patent [19]

Damitio

[11] Patent Number: 5,117,076

[45] Date of Patent: May 26, 1992

[54] QUIETING DEVICE FOR KEYTOP LEVELING MECHANISMS

[75] Inventor: Stephen S. Damitio, Spokane, Wash.

[73] Assignee: Key Tronic Corporation, Spokane, Wash.

[21] Appl. No.: 410,941

[22] Filed: Sep. 22, 1989

[51] Int. Cl.[5] ..... H01H 13/70; H01H 3/60

[52] U.S. Cl. ..... 200/344; 200/345; 200/301

[58] Field of Search ..... 200/344, 345, 301, 512, 200/5 A

[56] References Cited

U.S. PATENT DOCUMENTS

| | | | |
|---|---|---|---|
| 4,181,826 | 1/1980 | Latasiewicz | 200/344 |
| 4,384,796 | 5/1983 | Denley | 200/344 X |
| 4,902,862 | 2/1990 | Oelsch et al. | 200/344 |

*Primary Examiner*—Henry J. Recla
*Assistant Examiner*—David J. Walczak
*Attorney, Agent, or Firm*—Wells, St. John & Roberts

[57] ABSTRACT

Excess clearance provided between a multi-wide keytop and a rigid supporting housing layer is removed by provision of yieldable projections that extend upwardly beyond the housing layer and engage the movable leveling bar. The projections are formed integrally with an underlying dome sheet of elastomeric material and protrude through complementary openings formed through the housing layer.

7 Claims, 2 Drawing Sheets

QUIETING DEVICE FOR KEYTOP LEVELING MECHANISMS

TECHNICAL FIELD

This invention relates to computer keyboards, and specifically to improvements in a leveling mechanism for multi-wide keytops.

BACKGROUND OF THE INVENTION

Multi-wide keytops are utilized in computer keyboards for a number of commonly used function keys, such as the spacebar, the shift keys, and the entry key. In most multi-wide keytop applications, the extra width of the keytop extends parallel to the width of the keyboard. However, in keys such as the entry key, the extra width of the keytop extends from front to back, and sometimes extends transverse to the keyboard as well.

Keytops spanning the width (or height) of at least two normal key spaces (about 1.5 inches in length) and larger are typically designed to accept a crank or "leveling bar" that converts a pushing motion at one end of the keytop into a pulling motion at its opposite end. This mechanism allows a large key to be guided in the same manner as a normal keytop. The operative plunger supporting the keytop can be positioned either at its center or off-center. The leveling bar assures that a large keytop can be manually operated by the user at an off-center location about its top area without binding of the keytop supports. Leveling bars are typically steel wire forms that move within their mating plastic parts with substantial clearance to accommodate the necessary tolerances permitted in keyboard assembly to accommodate differing materials, molding procedures and fabricating techniques. The required clearances between the leveling bars and mating plastic parts result in objectionable noise or rattle when the keytop is depressed or operated.

The present invention was designed to eliminate the loose connection between a leveling bar and its mating keyboard parts without modifying their structure or interfering with their intended purposes. It can be readily provided in a keytop assembly without substantial additional parts, expense or fabrication steps.

BRIEF DESCRIPTION OF THE DRAWINGS

The preferred embodiment of the invention is illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

The drawings illustrate operational keyboard components associated with keytops in the absence of the outer keyboard enclosure, which is not illustrated. These illustrative components include a keytop support provided by a rigid housing layer 13 carrying fixed bearings 12. The bearings 12 slidably receive complementary plungers 11 that protrude beneath the keytops.

Figure 1:
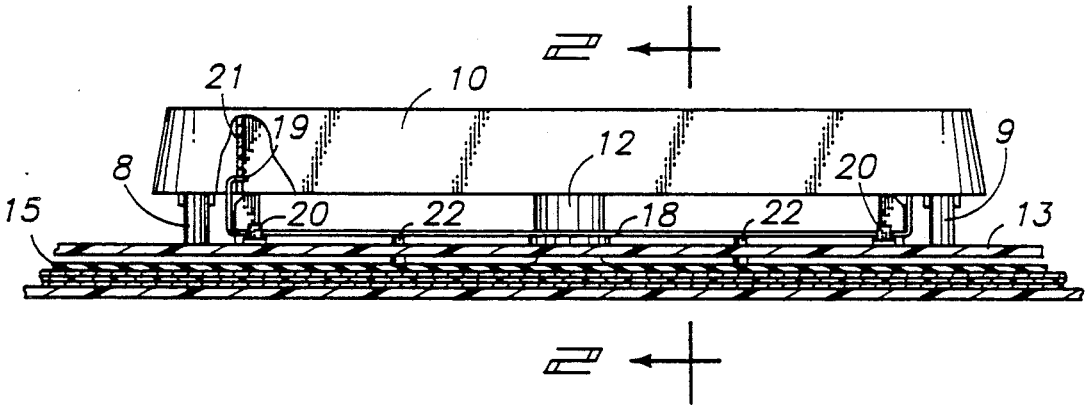
FIG. 1 is a front view of a spacebar assembly within a keyboard, modified to include the present improvement.
Figure 2:
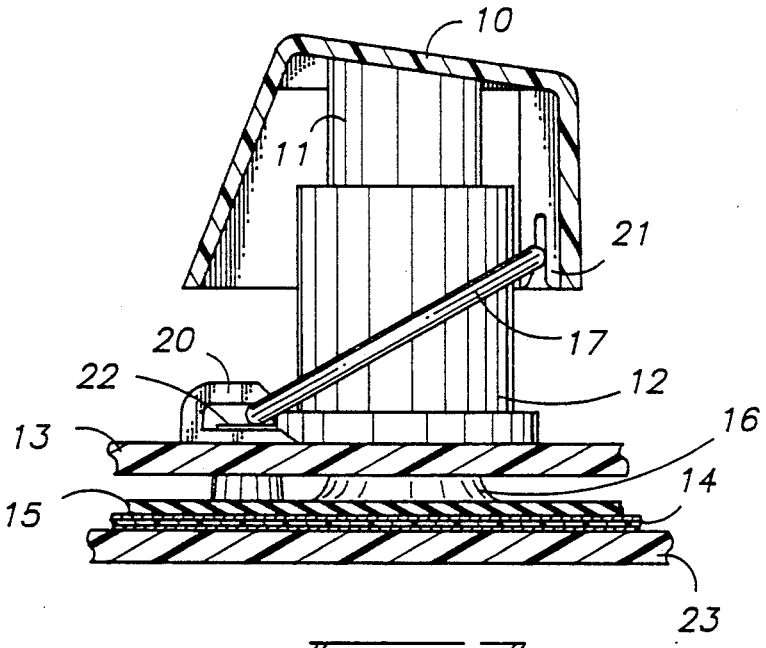
FIG. 2 is an enlarged transverse sectional view taken along line 2—2 in FIG. 1.
Figure 3:
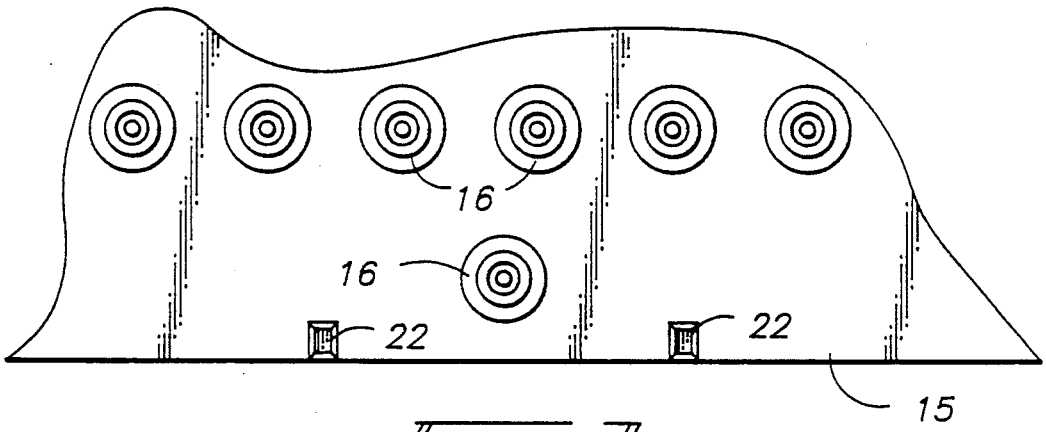
FIG. 3 is a fragmentary plan view of a dome sheet incorporating the present improvement.
Figure 4:
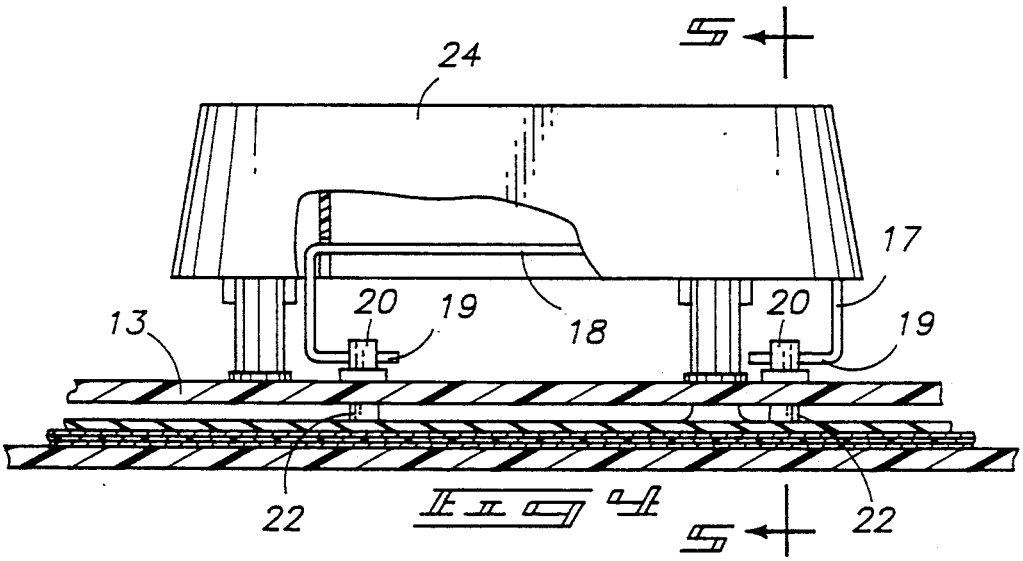
FIG. 4 is a view similar to FIG. 1, showing a second embodiment of the invention.
Figure 5:
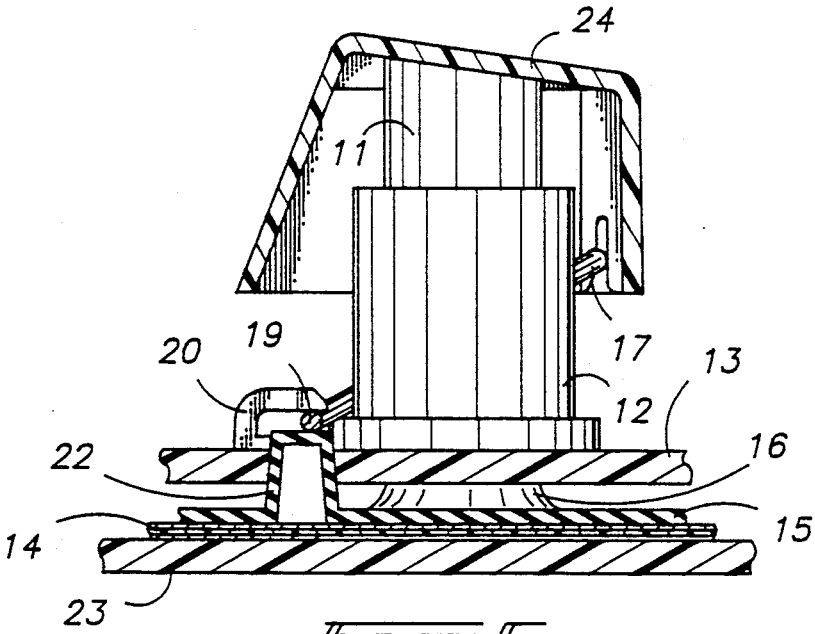
FIG. 5 is an enlarged transverse sectional view taken along line 5—5 in FIG. 4.

FIGS. 1-3 illustrate components for supporting a movable keytop 10 used as a spacebar. FIGS. 4 and 5 show a smaller, multi-wide keytop 24.

A spacebar is typically a multi-wide keytop mounted across the front center of an alpha-numeric keyboard layout. it is usually guided on the keyboard assembly by a central plunger 11 slidably received within a supporting bearing mounted to an interior housing layer 13 of rigid plastic or metal construction. Auxiliary guides 8 and 9 can also be provided to maintain the moving keytop 10 in alignment with respect to housing layer 13. The spacebar keytop 10 overlies associated computer switching devices. (Such as contacts, capacitance elements, etc.) that are activated in response to depression of the keytop 10. These are aligned under the plunger 11 within an underlying membrane switch assembly 14. The membrane switch assembly is in turn supported by a frame or rigid layer 23.

In the illustrated keytop construction, an elastomeric dome sheet 15 is positioned between the membrane switch assembly 14 and the plunger 11 associated with the spacebar keytop 10. Dome sheet 15 (FIG. 3) includes a plurality of yieldable domes that protrude upwardly from the sheet 15 and are aligned individually with the respective plungers for the various keytops in the keyboard. As illustrated in FIGS. 1 and 2, a dome 16 is aligned directly under plunger 11 for the spacebar keytop 10. Dome 16 provides a resilient spring normally urging the keytop 10 to its outer or relaxed condition, as well as a contacting actuator for the underlying membrane switch. Dome 16 provides controlled resistance to manual depression of the spacebar keytop 10 to provide the desired "touch" or feel to the keytop 10 as it is depressed by the user.

Because the spacebar keytop 10 is much wider than the area directly above plunger 11, it is conventional to provide a transverse leveling bar 17 to transfer forces across the keytop 10 and to counteract the tendency of plunger 11 to bind within its supporting bearing 12.

The illustrated leveling bar is a bent rod or wire having an elongated wire section 18 that spans a substantial portion of the keytop adjacent to the upper surface of housing layer 13. It is movably connected to the upper surface of the supporting housing layer 13 by means of protruding bearing hooks 20 that provide an open slot wherein spaced sections of the elongated wire section 18 are freely received. These slots (see FIG. 2) accommodate both translational and pivotal movement of leveling bar 17 relative to housing layer 13 as keytop 10 moves up or down.

The leveling bar 17 also includes a pair of offset end wire sections 19 that are movably connected to the keytop 10 at spaced positions across it. The interconnections between the housing layer 13 and keytop 10 provided by leveling bar 17 maintain the keytop 10 in a substantially level orientation regardless of the keytop area engaged by a user during its operation.

To eliminate the clearance or play often encountered in the bearing hooks 20 that interconnect leveling bar 17 and housing layer 13, one or more projections 22 of elastomeric material are molded integrally with the dome sheet 15 at positions that are located immediately under the elongated wire section 18 of leveling bar 17 in the assembled keyboard. The yieldable projections 22 protrude through complementary apertures formed in the housing layer 13 and extend between the housing layer 13 and the leveling bar adjacent to it.

Projections 22 are frictionally engaged against the elongated wire section 18 of the leveling bar 17 to remove mechanical clearance in the movable connection between it and the housing layer 13. The projections 22 exert a slight preloading force on the leveling bar 17 to push its engaged sections against the adjacent plastic bearing surfaces of the bearing hooks 20 that guide it on housing layer 13. The clearance between the leveling bar 17 and bearing hooks 20 is effectively removed by this preloading force. The resulting noise or rattling of the leveling bar 17 during use of the keyboard is greatly reduced. Due to its elastomeric construction, the individual projections 22 are sufficiently compliant to accommodate tolerance variations in the related keyboard components without causing leveling bar 17 to bind.

Projections 22 can be provided between the bearing hooks 20 (FIGS. 1 and 2) or directly under the bearing hooks 20 (FIGS. 4 and 5).

FIGS. 4 and 5 illustrate application of projection 22 to the leveling bar 17 connected to a multi-wide "shift" keytop 24. As shown in FIGS. 4 and 5, the projections 22 can also be utilized with a reversed orientation of the leveling bar 17, wherein the elongated wire section 18 is mounted adjacent to the keytop 24 and the end wire sections 19 are loosely carried within the bearing hooks 20 previously described.

The illustrated shape and size of projections 22 can be varied to assure proper frictional engagement of the leveling bar 17 throughout its range of motion during use of a particular multi-wide key. While projections 22 are preferably formed as part of an elastomeric dome sheet, they can also be individually molded and attached to a suitable frame element adjacent to a leveling bar, such as housing layer 13.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately in accordance with the doctrine of equivalents. interpreted

I claim:

1. In a computer keyboard:

a multi-wide keytop;

stationary keytop support means for guiding the keytop between a relaxed position and a depressed position;

a leveling bar extending across the keytop, the leveling bar being movably connected between the keytop support means and the keytop to maintain it in a substantially level orientation; and one or more compliant projections, each projection being frictionally engaged between the keytop support means and the leveling bar to exert a preloading force on the leveling bar and thereby remove any mechanical clearance existing between the leveling bar and the keytop support means;

the keyboard further comprising:

an elastomeric sheet including a dome operator operable in conjunction with the keytop;

the compliant projections being formed integrally with the elastomeric sheet and protruding through complementary openings formed through the keytop support means.

2. The computer keyboard of claim 1, wherein the leveling bar has an elongated wire section movably connected to the keytop support means and extending across the keytop and a pair of offset end wire sections movably connected to the keytop support means; and the compliant projections engage the elongated wire section.

3. The computer keyboard of claim 1, wherein the leveling bar has an elongated wire section movably connected to the keytop support means and extending across the keytop and a pair of offset end wire sections movably connected to the keytop support means; and the compliant projections engage the end wire sections.

4. The computer keyboard of claim 1, further comprising:

a pair of bearing hooks on the keytop support means mounting the leveling bar for translational and pivotal motion relative to the keytop support means;

the projections being located at spaced positions along the leveling bar between the bearing hooks.

5. The computer keyboard of claim 1, further comprising:

a pair of bearing hooks on the keytop support means mounting the leveling bar for translational and pivotal motion relative to the keytop support means;

the projections being located at spaced positions along the leveling bar directly under the bearing hooks.

6. An elastomeric dome sheet comprising:

a plurality of yieldable dome operators protruding from the sheet in a common direction, the dome operator being adapted to be used in a keyboard having a multi-wide keytop mounted by a support assembly including a leveling bar; and one or more compliant projections formed integrally with the elastomeric sheet and protruding in a direction common to the protruding dome operators, the compliant projections being positioned about the sheet to yieldably engage a leveling bar for a multi-wide keytop and thereby remove clearance between the leveling bar and a support assembly associated with it.

7. The elastomeric dome sheet of claim 6, wherein the projections are arranged on the sheet in aligned pairs.

* * * * *